US006155225A

United States Patent [19]

Suzuki

[11] Patent Number: 6,155,225

[45] Date of Patent: Dec. 5, 2000

[54] VEHICLE ENGINE INTAKE MUFFLER

[75] Inventor: Takehiro Suzuki, Hamamatsu, Japan

[73] Assignee: Suzuki Motor Corporation, Japan

[21] Appl. No.: 09/362,930

[22] Filed: Jul. 28, 1999

[30] Foreign Application Priority Data

Oct. 8, 1998 [JP] Japan ..... 10-286329

[51] Int. Cl.[7] ..... F02M 35/12

[52] U.S. Cl. ..... 123/184.57

[58] Field of Search ..... 123/184.53, 184.57; 181/204

[56] References Cited

U.S. PATENT DOCUMENTS

| | | | |
|---|---|---|---|
| 5,002,021 | 3/1991 | Nakata et al. | 123/184.57 |
| 5,040,495 | 8/1991 | Harada et al. | 123/184.57 |
| 5,918,572 | 7/1999 | Suzuki | 123/184.57 |
| 6,006,712 | 12/1999 | Suzuki | 123/184.57 |

FOREIGN PATENT DOCUMENTS

| | | |
|---|---|---|
| 7-103094 | 4/1995 | Japan . |
| 9-317581 | 12/1997 | Japan . |

*Primary Examiner*—M. McMahon
*Attorney, Agent, or Firm*—Morrison Law Firm

[57] ABSTRACT

A series of resonators are affixed to a vehicle engine air intake pipe path to provide muffling of air intake noises. An air intake port, facing toward the front of the vehicle, has a midsection bent back on itself. A connection opening is provided on the bent-back part. A pipe-form resonator, having a closed-off tip, is bent back on itself in roughly a U-shape at its midsection. A base end of the resonator is joined to the connection opening of the air intake port. This resonator makes it possible to muffle intake sound of frequencies that heretofore could not be absorbed by other affixed resonators.

11 Claims, 8 Drawing Sheets

VEHICLE ENGINE INTAKE MUFFLER

BACKGROUND OF THE INVENTION

The present invention relates to a vehicle engine intake muffler. More specifically, the present invention relates to a vehicle engine intake muffler for quieting the intake system of an automobile engine.

An automobile engine takes in air, mixes it with fuel, and then burns the air/fuel mixture. The larger the output of the engine, the greater the amount of air which must be taken in. As air is taken into the engine, the air produces an intake sound. This sound is naturally louder as the amount of air taken in increases. At times, the intake sound is loud enough to be heard inside the vehicle, making the ride less pleasant. The intake sound is reduced or eliminated by attaching a resonator to a part of the intake pipe path. The intake sounds vary in frequency, depending on the intake path and engine shape and volume. A resonator, however, is unable to reduce all frequencies of intake sound. There are some sounds that a resonator can effectively reduce or eliminate. On the other hand, there are some intake sounds on which a resonator has little effect.

Since today's automobiles finely control their engine to match many conditions, the frequencies of intake sound are not monotonic but highly varied. This is dealt with by attaching multiple resonators for different intake frequencies to a single intake pipe path. Today's automobiles, however, have a large number of accessories to meet various requirements, such as better engine efficiency, cleaner exhaust gas, and improved brake performance. These accessories reduce the space available in the engine compartment, imposing many constraints on where resonators can be located.

Some of the parts of the intake pipe path are relatively bulky. By housing these bulky parts inside the front-wheel fenders, which usually is dead space, space in the interior of the engine compartment is freed to readily accommodate other equipment as well as the engine. If parts of the intake system are put inside the fenders however, when the vehicle runs down a flooded street, there is danger that splashed water will get sucked into the intake pipe path. Thus, it is necessary to have some means to eliminate water from getting inside the intake pipe path.

Referring to FIGS. 9 and 10, a conventional method of arranging part of the intake pipe path inside the fender is illustrated. An automobile 1 has a fender 3 above front wheel 2. A bumper 4 is located to the front of fender 3. A headlamp 5 is at the front of fender 3. An air suction pipe 6, whose midsection is bent in roughly a U shape, is inside fender 3. An intake port 6*a* faces forward at the tip of air suction pipe 6. Since intake port 6*a* is the source of the intake noise, air suction pipe 6 has a structure in which the part that faces toward the rear of the chassis is bent in a U shape toward the front, away from the driver's seat.

The base end of air suction pipe 6 is joined through an air suction hose 7 to the intake side of an air cleaner 8. A connection opening 9*a* of a first resonator 9 connects to a part where air suction hose 7 branches. First resonator 9, having a large volume with respect to the other resonators, is positioned inside bumper 4.

The outlet side of air cleaner 8 joins to the engine intake manifold through an air cleaner outlet hose 10 and a throttle body (not shown). Between part of air cleaner 8 and the midsection of air cleaner outlet hose 10, a second resonator 11, having the shape of a crooked pipe, is connected by clip 12.

In the convention intake pipe path, air taken in from intake port 6*a* of air suction pipe 6 goes through air suction hose 7 to enter air cleaner 8, where dust is removed. The air then enters the engine intake manifold from air cleaner outlet hose 10 via the throttle body. In this process, a pulsing sound is produced by the intake pulsing as the engine intake valve opens and closes. This pulsing sound is a relatively low-frequency sound whose fundamental period is the ignition period, but it is effectively attenuated by first and second resonators 9 and 11.

Of the two resonators 9 and 11, first resonator 9, on the intake side of air cleaner 8, does not have any strict requirement for airtightness of its junction part. Thus, first resonator 9 is attached by being fitted into air suction hose 7. Second resonator 11, on the outlet side of air cleaner 8, has a greater need for airtightness. Thus, second resonator 11 is firmly held in place by clip 12. Because first resonator 9 is in a relatively low position, it tends to collect water that intrudes from the various parts of the intake pipe path. When water pools in first resonator 9, the frequency of the suction sound changes, and the designed effect is not obtained. To avoid this, a small hole 9*a* drains water from first resonator 9.

First and second resonators 9 and 11 are used in the above-described structure. As stated above, however, modern engines produce intake sounds of multiple frequencies. Since automobile users have an increasingly strict desire to muffle these sounds, it is desirable to have a greater number of resonators. However, it has been difficult to put on a third resonator simply, easily, and cheaply in the limited space that is available.

A structure of a muffler that reduces the noise in multiple different frequency ranges is disclosed in Japanese unexamined patent application publication H9-317581 [1997]. The invention of this publication has first and second chambers arranged parallel to each other on opposite sides of the duct pipe. Air is introduced, and noise in different frequency ranges is reduced by these first and second chambers. The difference between the structure of JP H9-317581 and the conventional structure described above is that the first and second chambers are integrally joined to the two ends of the duct pipe. However, since there are still only two chambers, the sound-deadening effect is the same as in the above-described conventional product.

A structure in which the length of the path to which the resonator is connected is varied is disclosed in Japanese unexamined patent application publication H7-103094 [1995]. The invention of this publication has, in the resonator-side pipe path, a path length setting wall part that sets the length of the path. However, this structure has only one resonator structure Thus, its content is different from the present invention, which seeks to increase the number of resonators in a product that has multiple resonators.

OBJECTS AND SUMMARY OF THE INVENTION

It is an object of the present invention to provide an intake device for an internal combustion engine which overcomes the foregoing problems.

More specifically, it is an object of the present invention to provide a structure having a third resonator to muffle air intake sounds of various frequencies.

It is a further object of the present invention to provide a structure to muffle air intake sounds of various frequencies which requires little or no additional spacial requirements with respect to conventional structures.

The present invention is characterized in that, as a means for solving the above problems, a first embodiment of the present invention which includes the intake port at the tip facing toward the front of the vehicle. The midsection is bent back, and a connection opening is provided on the bent-back part of the roughly U-shaped air suction pipe. The base end of a pipe-form resonator, whose tip is closed off and bent back roughly U-shaped in its midsection, is joined to the connection opening.

According to a feature of the embodiment described above, the air suction pipe and resonator are accommodated inside the front-wheel fender of the vehicle. The lengthwise direction of the resonator is held substantially horizontal with respect to the vehicle on a level surface.

According to another feature of the embodiment described above, the internally touching parts where the resonator is bent back are joined with a flat plate. A notch is provided in the part corresponding to the base end of the flat plate.

According to another feature of the embodiment described above, the base end of a pipe-shaped resonator that connects to the bent-back part of the air suction pipe protrudes slightly from the adjacent closed-off tip.

Briefly stated, the present invention relates to a series of resonators affixed to a vehicle engine air intake pipe path to provide muffling of air intake noises.

An air intake port, facing toward the front of the vehicle, has a midsection bent back on itself. A connection opening is provided on the bent-back part. A pipe-form resonator, having a closed-off tip, is bent back on itself in roughly a U-shape at its midsection. A base end of the resonator is joined to the connection opening of the air intake port. This resonator makes it possible to muffle intake sound of frequencies that heretofore could not be absorbed by other affixed resonators.

According to another embodiment of the present invention, there is provided a vehicle engine air intake muffler, guiding a flow of air on an air path from outside an engine to inside an engine, comprising a first resonator in the air path, muffling sounds according to its shape and volume; a second resonator in the air path, muffling sounds according to its shape and volume; and a third resonator in the air path, muffling sounds according to its shape and volume.

According to a further embodiment of the present invention, there is provided a resonator for reducing sounds due to an air flow along an air path comprising a first end of a pipe attached to a connection opening in the air path; a second, opposite end of the pipe being closed; and the pipe having a bend at a midsection thereof with an air space between the bend to the second, opposite end substantially parallel to an air space between the bend to the first end.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Referring to FIGS. 1 through 6, a connection opening 6*b* is provided on the bent-back part of an air suction pipe 6. A base end 13*a* of third resonator 13 joins with connection opening 6*b*. Third resonator 13, which is preferably made by blow-molding with a synthetic resin, is in the form of a pipe bent back in its midsection roughly in the shape of a U. A tip 13*b* of third resonator 13 is closed off. Base end 13*a*, which connects to air suction pipe 6 of third resonator 13, protrudes slightly from adjacent closed-off tip 13*b*. Base end 13*a* is longer than closed-off tip 13*b* by a length X (see FIG. 5).

The internally touching parts where third resonator 13 is bent back, are joined by a flat plate 13*c* to increase the rigidity of third resonator 13. A notch 13*d* is provided at the front part of flat plate 13*c*. Notch 13*d* allows the tools to be freely oriented when this part is cut for the operation of burr removal following blow-molding. Base end 1 3*a* is easily inserted when it is connected to air suction pipe 6, thereby improved operability.

Figure 7:
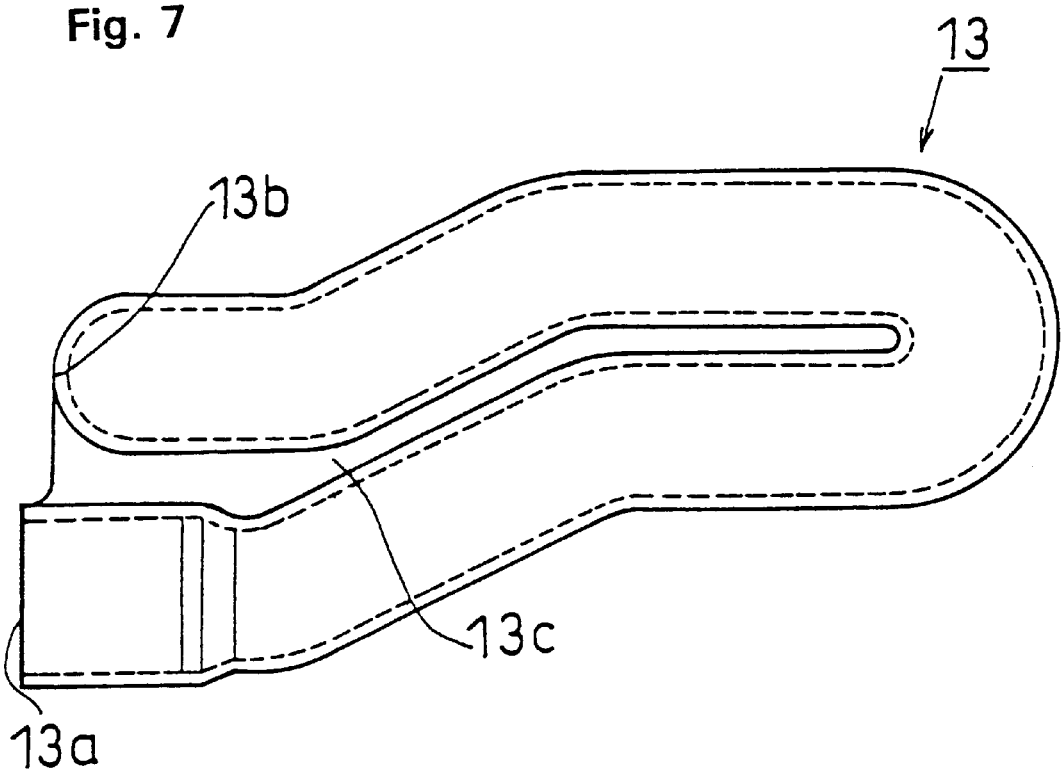
FIG. 7 is a top view showing an embodiment of the resonator of FIG. 5.
Figure 8:
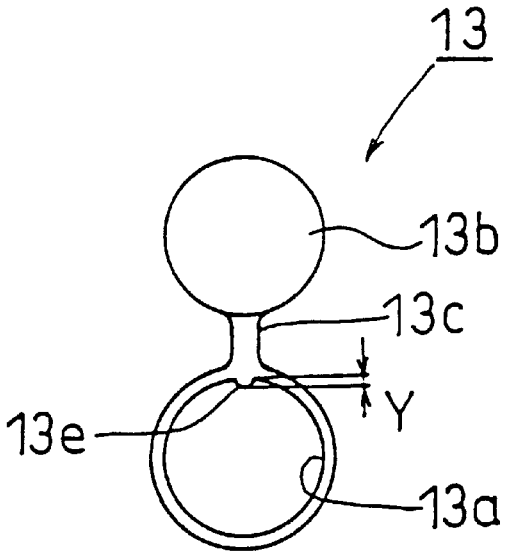
FIG. 8 is a front view of the resonator of FIG. 7.
Figure 9:
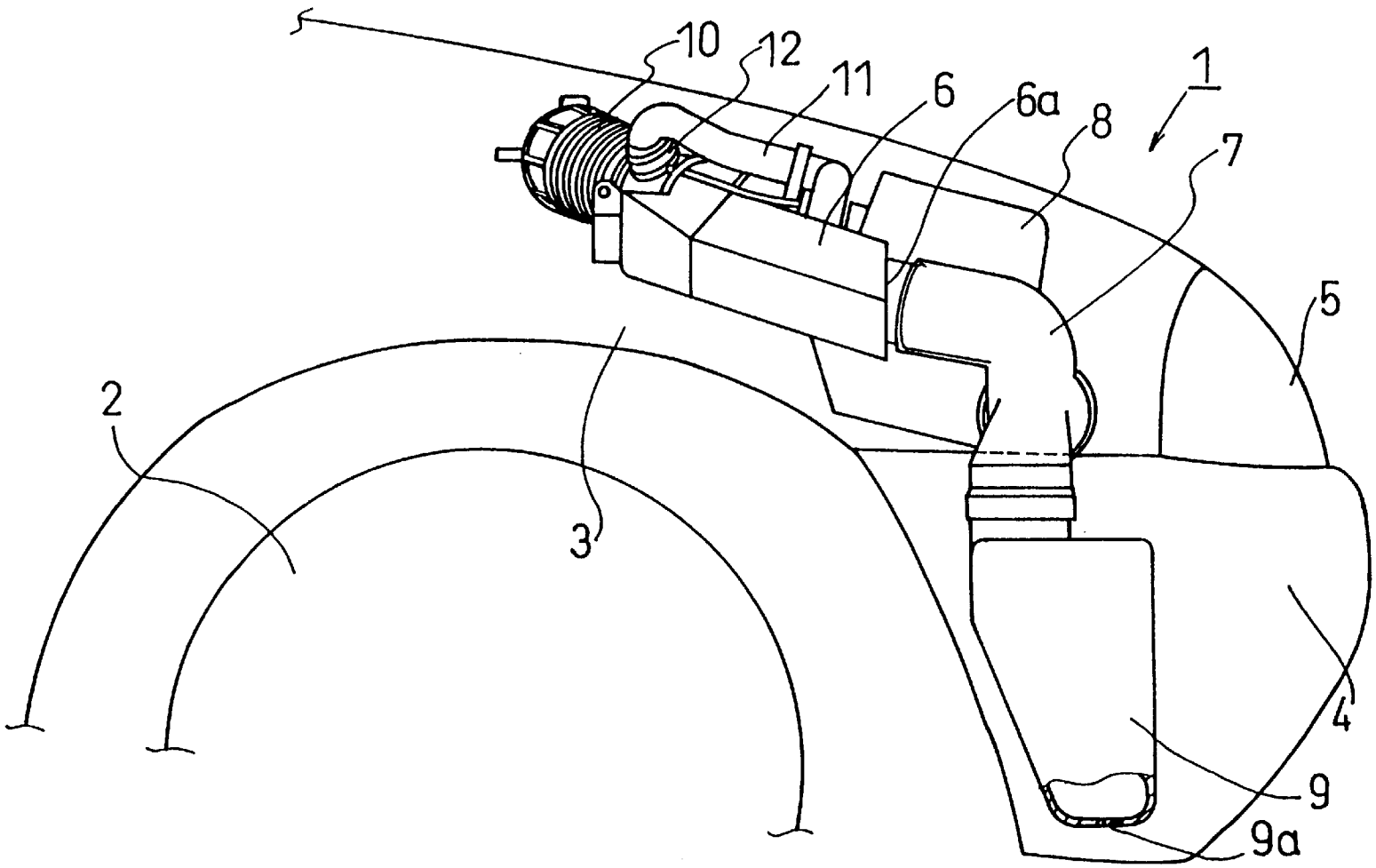
Fig. 9 PRIOR ART
FIG. 9 is a partially cut-away side view showing a conventional air intake structure.
Figure 10:
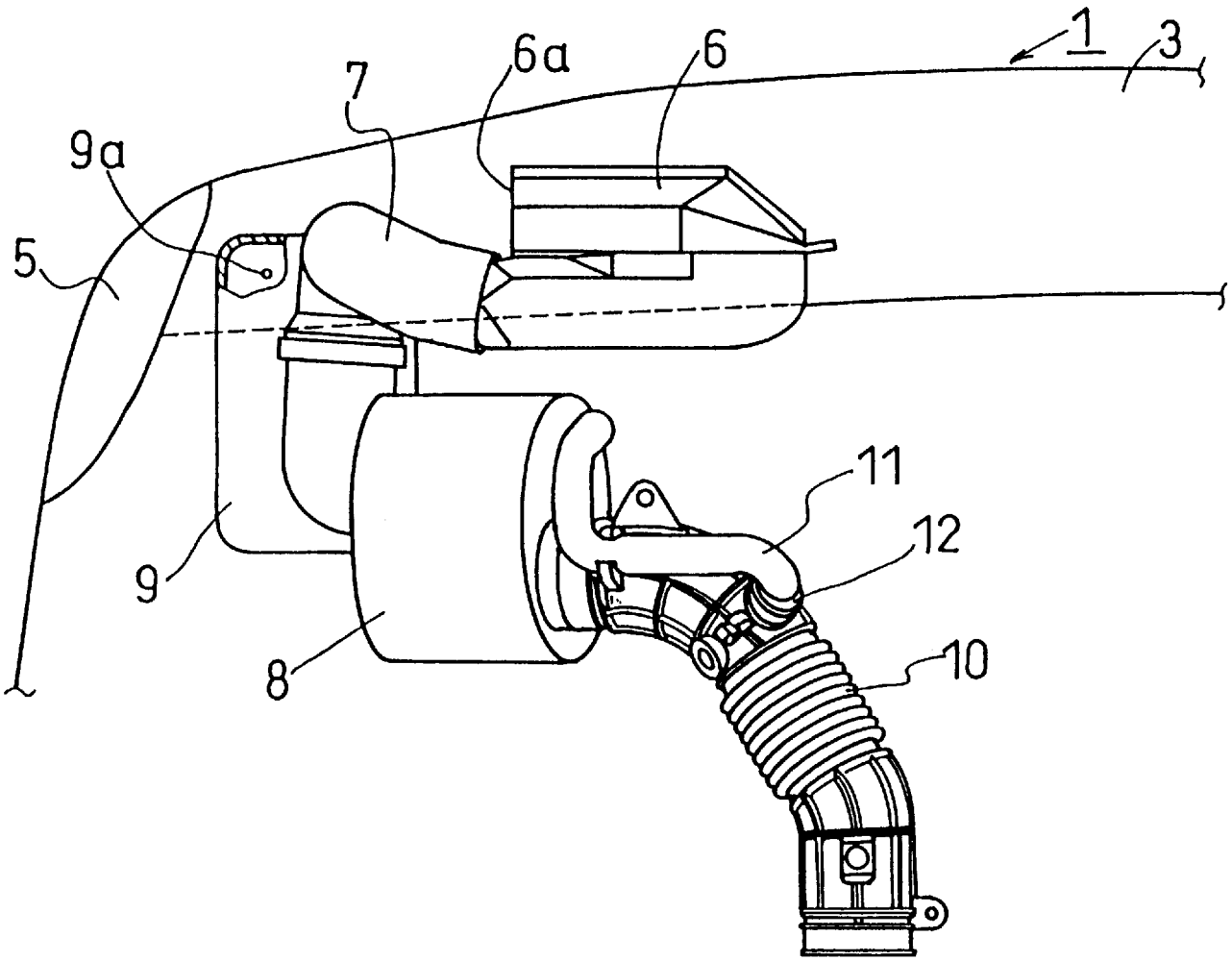
Fig. 10 PRIOR ART
FIG. 10 is a top view of the convention air intake structure of FIG. 9.

Referring to FIGS. 7 and 8, if third resonator 13, which is preferably made by blow molding, is made without notch 1 3*d*, then during blow-molding, the resin of part of flat plate 13*c* will protrude to the inside of base end 13*a*. A protrusion 13*e* having a height Y makes assembly of base end 13*a* onto connection opening 6*b* more difficult.

Figure 1:
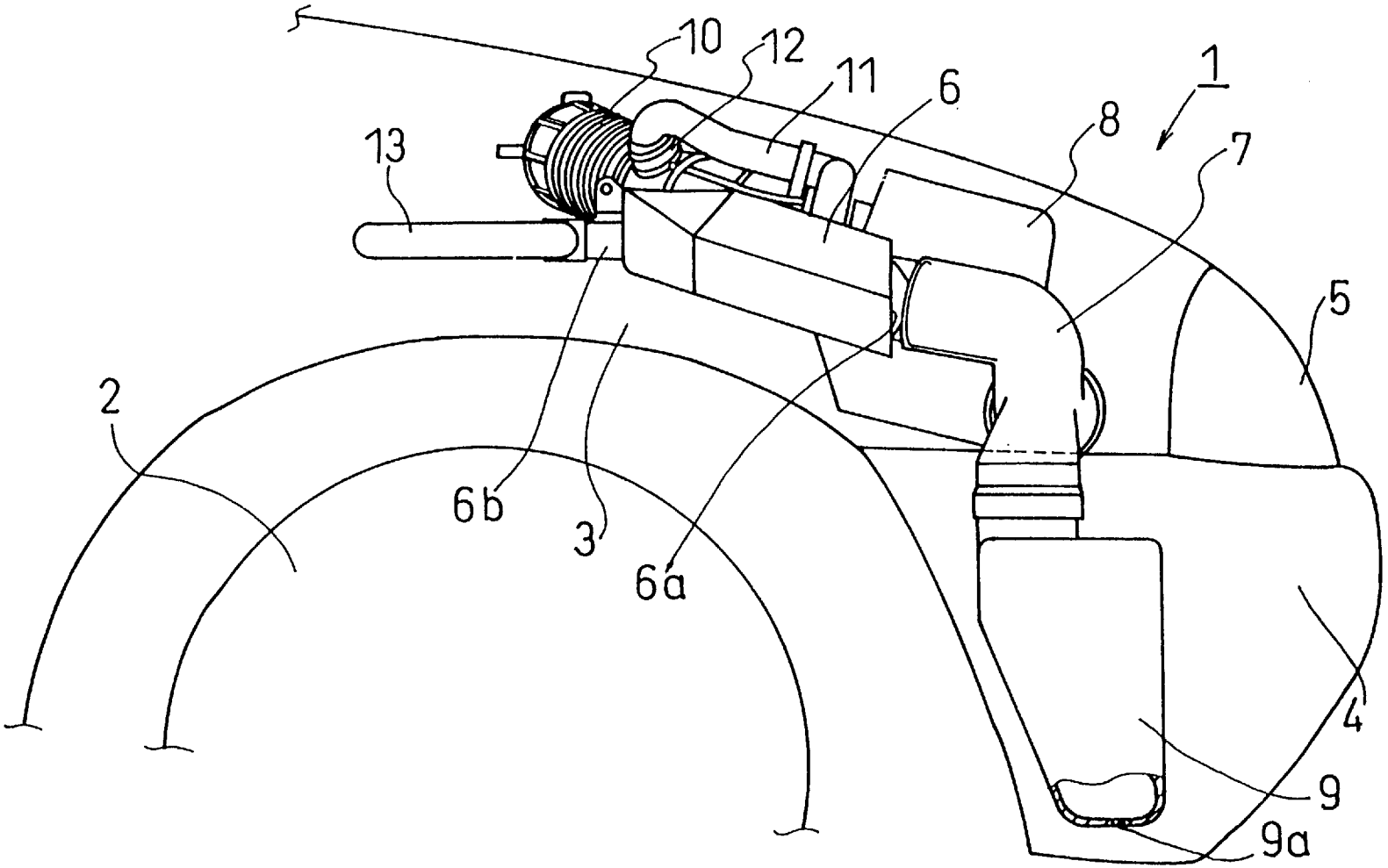
FIG. 1 is a partially cut-away side view of an embodiment of the present invention as seen from inside the fender of an automobile.
Figure 2:
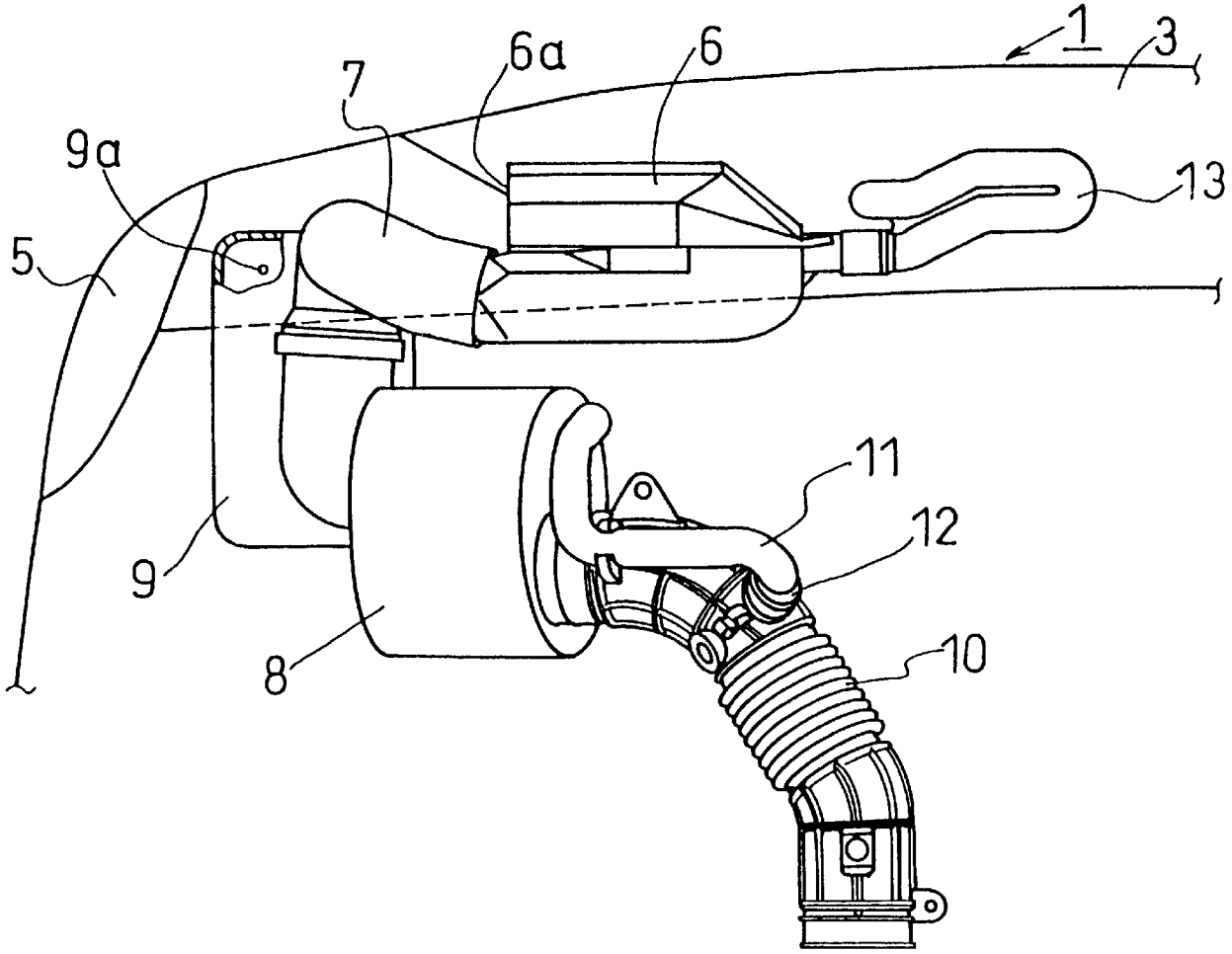
FIG. 2 is a partially cut-away top view of the embodiment of FIG. 1.
Figure 3:
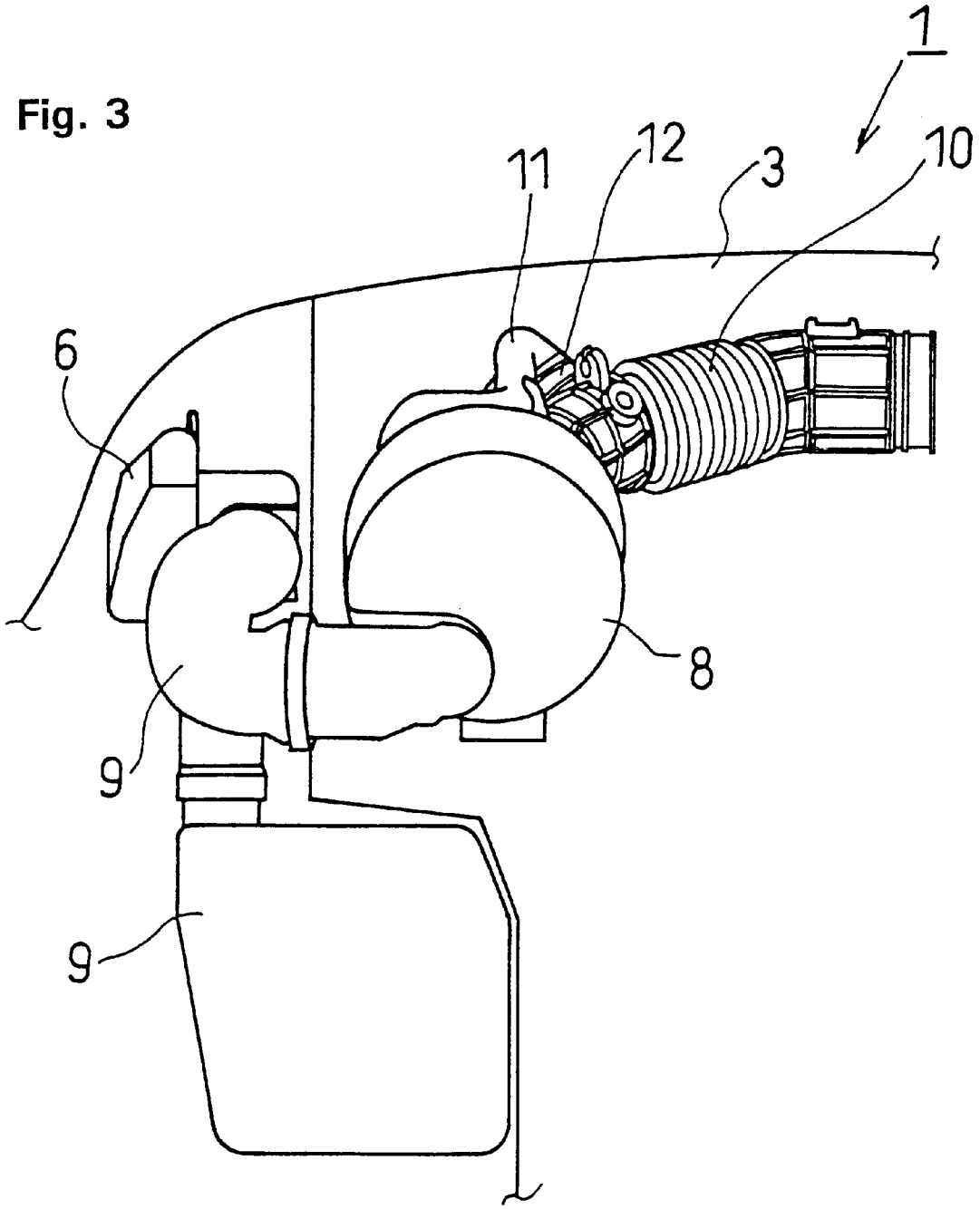
FIG. 3 is a front view of the embodiment of FIG. 1.

Referring now to FIG. 1, third resonator 13 is housed, together with air suction pipe 6, inside a front-wheel fender 3. A lengthwise direction of third resonator 13 is held horizontal with respect to the chassis, as shown in FIG. 1. Holding third resonator 13 horizontal keeps it from interfering with the arrangement of other structural members not shown in the figures. Furthermore, the horizontal placement of third resonator 13 allows its angle with respect to air suction pipe 6 to be kept small.

Figure 4:
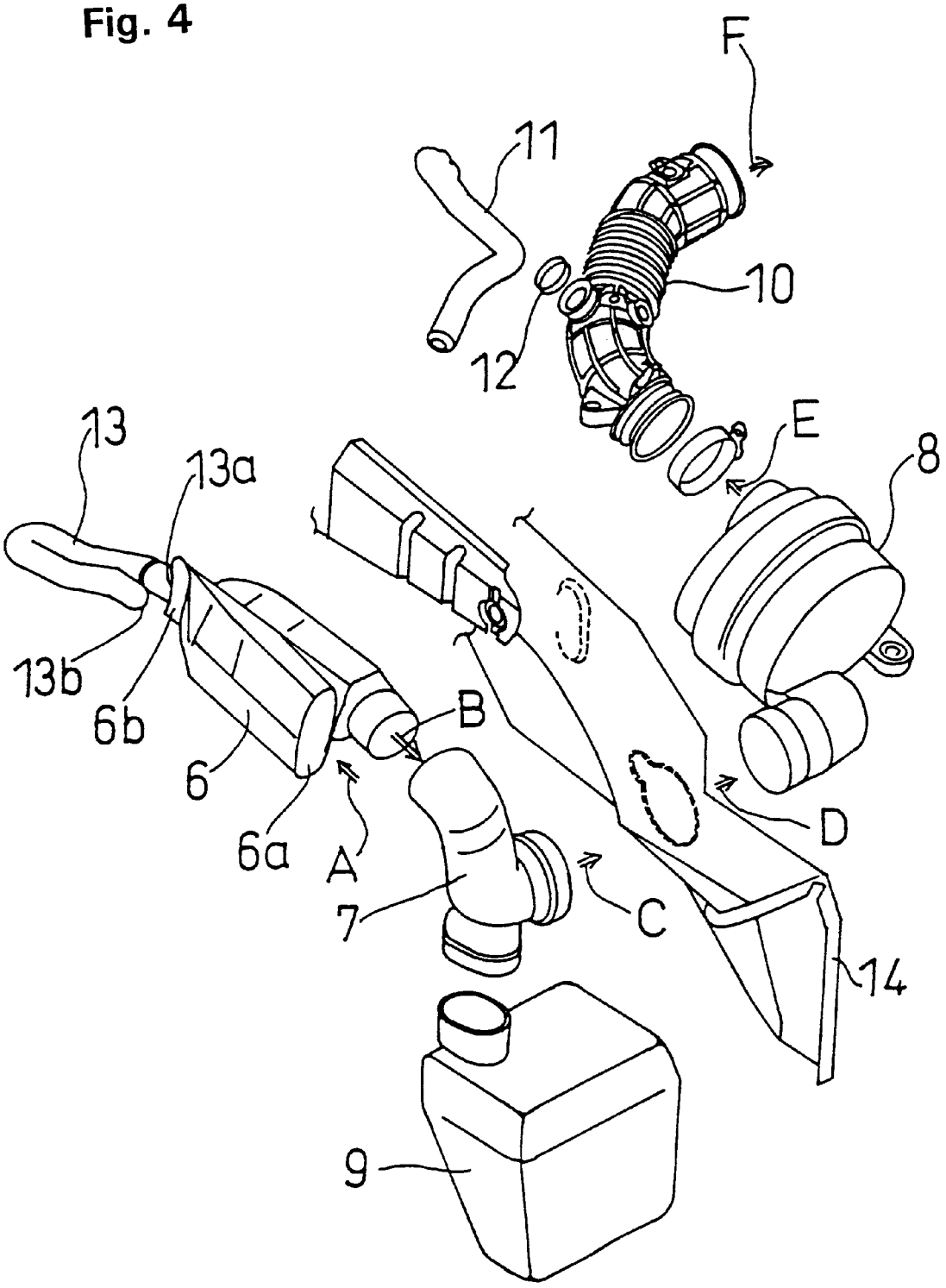
FIG. 4 is a perspective view showing the assembly of separate parts.
Figure 5:
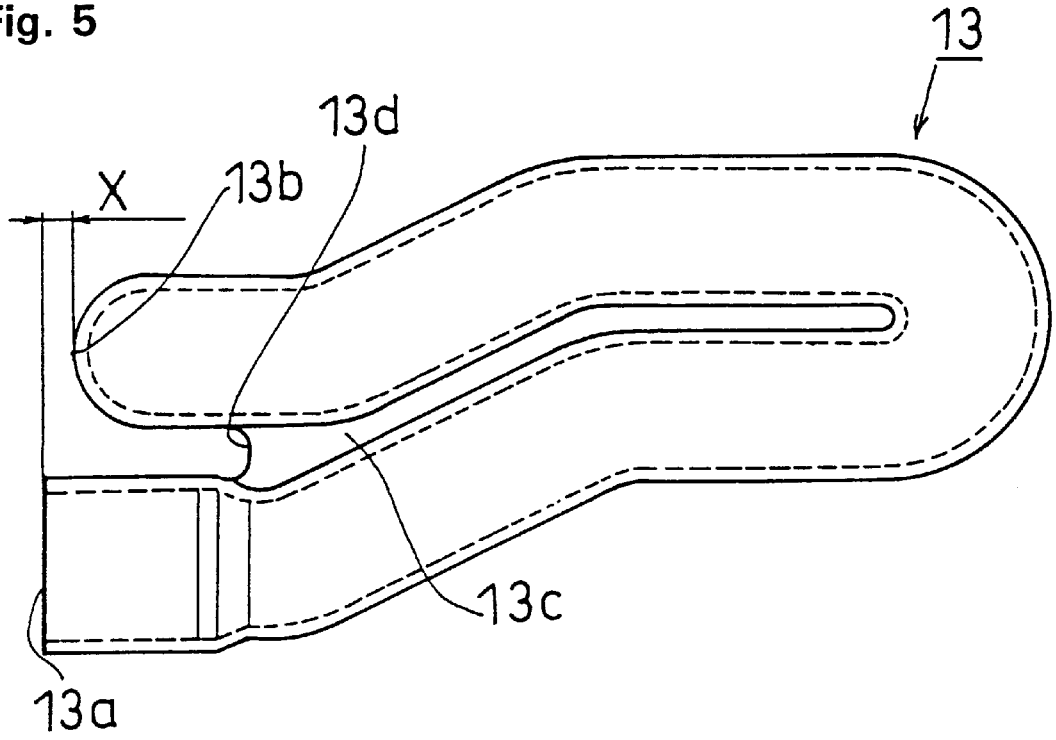
FIG. 5 is a top view of the resonator of the present invention.
Figure 6:
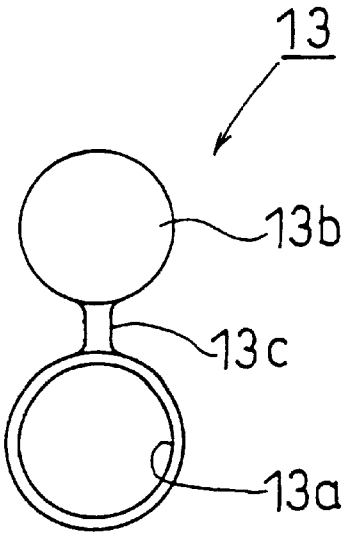
FIG. 6 is a front view of the resonator of FIG. 5.

Referring to FIG. 4, which shows the structural members of the air intake muffler in exploded form, the flow of air is indicated by arrows A–F. The left side of a chassis portion 14 is the side of fender 3 (not shown). the right side of chassis portion 14 is the engine compartment side. Air enters air suction pipe 6 from the outside, as indicated by arrow A. The air goes through suction pipe 6 and is bent back in a U shape to enter air suction hose 7, as indicated by arrow B. Since third resonator 13 is connected to the bent-back part of air suction pipe 6, sound is muffled in accordance with its shape and volume.

Air that emerges from air suction hose 7 enters air cleaner 8, as indicated by arrows C and D. Since first resonator 9 is connected to this part, sound is muffled in accordance with its shape and volume. Air that emerges from air cleaner 8 enters air cleaner outlet hose 10, as indicated by arrow E. Air leaves outlet hose 10, as indicated by arrow F, and enters the engine's intake manifold through the throttle body (not shown). Since second resonator 11 is connected to this part, sound is muffled in accordance with its shape and volume.

When the vehicle runs down a flooded street, there is danger that splashed water will be sucked into the air intake pipe path. If this happens, however, the water is drained away through a water drain hole provided in the base of the first resonator.

As described above, this embodiment of the present invention uses three resonators, namely first, second, and third resonators 9, 11, and 13. Of these, first resonator is preferably of volume type, being effective in muffling sounds in a wide frequency range. Second resonator 11 is preferably of air-column type, being effective in muffling sounds of a specified frequency in a narrow frequency range. Newly provided third resonator 13 is also preferably of air-column type. By appropriately prescribing its internal volume, third resonator 13 is effective in muffling sounds in a frequency range lower than those handled by second resonator 9.

Air suction pipe 6 and third resonator 13 are joined by fitting one into the other. Since both are preferably made by blow-molding with a synthetic resin, the tolerance of the internal shape with respect to the external shape is large, making it difficult to control the press-fitting interference. This problem is solved since third resonator 13, having an interior shape made with good precision, is fitted onto the outside of air suction pipe 6.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A vehicle engine air intake muffler, guiding a flow of air on an air path from outside an engine to inside an engine, comprising:

at least a first resonator;

said first resonator bing a pipe bent back near a midsection thereof in roughly a U shape:

an air suction pipe providing a first bend in said air path;

a first connection opening at said first bend;

a base end of said first resonator being attached at said first connection opening; and an end opposite said base end having a closed-off tip.

2. A vehicle engine air intake muffler, guiding a flow of air on an air path from outside an engine to inside an engine, according to claim 1, further comprising:

a material joining together adjacent sides of said second resonator; and a notch in said material such that said closed-off tip and said base end are not joined together by said material.

3. A vehicle engine air intake muffler, guiding a flow of air on an air path from outside an engine to inside an engine, according to claim 1, wherein said base end protrudes from said closed-of tip adjacent thereto.

4. A vehicle engine air intake muffler, guiding a flow of air on an air path from outside an engine to inside an engine, according to claim 1, wherein:

said air suction pipe and said first resonator are provided inside a front wheel fender of a vehicle.

5. A vehicle engine air intake muffler, guiding a flow of air on an air path from outside an engine to inside an engine, according to claim 4, wherein:

a lengthwise direction of said third resonator is held substantially horizontal with respect to said vehicle.

6. A vehicle engine air intake muffler, guiding a flow of air on an air path from outside an engine to inside an engine, according to claim 1, further comprising an air cleaner placed in said air path.

7. A resonator for reducing sounds due to an air flow along an air path comprising:

a first end of a pipe attached to a connection opening in said air path;

a second, opposite end of said pipe being closed; and said pipe having a bend at a midsection thereof, providing a first pipe length proximal to said connection opening, and a second pipe length distal to said connection opening, with said bend being between said first pipe length and said second pipe length, and said first pipe length being substantially parallel to said second pipe length.

8. A resonator for reducing sounds due to an air flow along an air path according to claim 7, further comprising:

a material joining together said first pipe and said second pipe length; and a notch in said material such that said second, opposite end and said first end are not joined together by said material.

9. A resonator for reducing sounds due to an air flow along an air path according to claim 7, wherein said first end protrudes a distance beyond said second, opposite end.

10. A vehicle engine air intake muffler, guiding a flow of air on an air path from outside an engine to inside an engine, comprising:

at least a first, a second, and a third resonator;

an air suction pipe providing a first bend in said air path;

an air suction hose providing a second bend in said air path;

an air hose providing a third bend in said air path;

a first connection opening at said first bend;

a second connection opening at a location along said second bend;

a third connection opening at a location along said third bend;

a base end of said first resonator being attached at said first connection opening;

a base end of said second resonator being attached at said second connection opening; and a base end of said third resonator being attached at said third connection opening.

11. A vehicle engine air intake muffler, guiding a flow of air on an air path from outside an engine to inside an engine, comprising:

a first resonator;

a second resonator, muffling sounds according to its shape and volume;

a third resonator, muffling sounds according to its shape and volume;

an air suction pipe providing a first bend in said air path;

a first connection opening at said first bend;

a base end of said first resonator being attached at said first connection opening; and at least one of said first resonator, said second resonator, and said third resonator is a resonator being effective in muffling sounds in a wide frequency range; and at least one of said first resonator, said second resonator, and said third resonator is a resonator being effective in muffling sounds in a narrow frequency range.

* * * * *